US012465154B2

(12) United States Patent
Luckcuck et al.

(10) Patent No.: US 12,465,154 B2
(45) Date of Patent: Nov. 11, 2025

(54) REFRIGERATED DISPLAY CASE CONDENSATION MANAGEMENT SYSTEMS AND METHODS

(71) Applicant: NKW Corporation, Lakeville, MN (US)

(72) Inventors: Martin Luckcuck, Lakeville, MN (US); James Wiff, Cologne, MN (US)

(73) Assignee: NKW Corporation, Lakeville, MN (US)

( * ) Notice: Subject to any disclaimer, the term of this patent is extended or adjusted under 35 U.S.C. 154(b) by 201 days.

(21) Appl. No.: 18/215,997

(22) Filed: Jun. 29, 2023

(65) Prior Publication Data

US 2024/0081556 A1 Mar. 14, 2024

Related U.S. Application Data

(60) Provisional application No. 63/405,558, filed on Sep. 12, 2022.

(51) Int. Cl.
*A47F 3/04* (2006.01)
*A47F 3/00* (2006.01)

(52) U.S. Cl.
CPC ..... *A47F 3/0478* (2013.01); *A47F 3/001* (2013.01); *A47F 3/0443* (2013.01)

(58) Field of Classification Search
CPC .. F25D 21/08; F25D 21/14; F25D 2321/1413; A47F 3/0478; A47F 3/001; A47F 3/0443
See application file for complete search history.

(56) References Cited

U.S. PATENT DOCUMENTS

| | | | | |
|---|---|---|---|---|
| 7,340,907 | B2 | 3/2008 | Vogh, III | |
| 8,250,873 | B2 | 8/2012 | Yoon et al. | |
| 2012/0042676 | A1* | 2/2012 | Graham | F25D 21/14 62/275 |
| 2013/0098091 | A1* | 4/2013 | Stephens | A47F 3/0482 62/247 |
| 2016/0025404 | A1 | 1/2016 | Zheng | |
| 2017/0020305 | A1* | 1/2017 | Fischer | F25D 21/14 |

* cited by examiner

*Primary Examiner* — Marc E Norman
(74) *Attorney, Agent, or Firm* — Dicke, Billig & Czaja, PLLC

(57) ABSTRACT

Condensation management systems and methods including a control unit and a plurality of auxiliary fan devices. The control unit includes fan, heating element and controller maintained by a housing, and a sensor. The auxiliary fan devices each include a fan electrically connected to the controller and that can be selectively installed to a refrigerated display case apart from the housing. The controller operates to prompt operation of the heating element, the fan, and the auxiliary fan devices in response to sensed information.

14 Claims, 8 Drawing Sheets

REFRIGERATED DISPLAY CASE CONDENSATION MANAGEMENT SYSTEMS AND METHODS

CROSS-REFERENCE TO RELATED APPLICATIONS

This U.S. Patent application claims the benefit of the filing date of U.S. Provisional Patent Application Ser. No. 63/405,558, filed Sep. 12, 2022, the entire teachings of which are incorporated herein by reference.

BACKGROUND

The present disclosure relates to systems and methods for managing or removing condensation on or at refrigerated display cases. More particularly, it relates to portable systems and methods for managing condensation formed on an exterior underside surface of a refrigerated display case.

Refrigerated display cases are commonplace in most grocery and convenience stores, storing and displaying cooled or even frozen products or other merchandise to consumers for potential purchase. Refrigerated display cases come in a variety of shapes and sizes, and typically include an external shell defining an interior storage region at which shelves or the like are maintained. Oftentimes, the refrigerated display case will include one or more glass (or other transparent material) access doors (e.g., sliding door, swinging door, etc.). A cooling or refrigeration system is also carried by the external shell for creating and maintaining the interior storage region at a desired temperature.

Prior to the 1990's, the supermarket business was less competitive, and therefore more profitable. This resulted in refrigerated display cases on the sales floor being replaced every 7-10 years. Since then, traditional grocers have had to push the life of refrigerated display cases to 20, 30 and even 40 years. Even with regular maintenance, refrigerated display cases can and will deteriorate significantly over time. Insulation breakdown, for example, can be a major problem. These and other factors can result in condensation forming on the metal undersides of the display case; the accumulated water eventually drips and pools onto the floor leading to unsightly appearances and safety concerns, and loss of refrigeration efficiency.

Refrigerated display case manufacturers have devised and implemented techniques to mitigate condensation or fogging along the glass door(s). These advancements are of minimal value for an older, already purchased and in-use display cases. Moreover, little, if any, thought has been given to addressing exterior/underside condensation. Instead, the accepted "solution" is to place a low-profile blower under the case to circulate air. While blowing a lot of cold, wet air around/under the display case can, in some situations, improve conditions somewhat, this approach is not a true root cause solution. Further, experience has shown that stores typically have a negative pressure in the store, drawing in humid air from the outside. This humidity naturally condenses where at or along objects that are below the dew point; namely, the underside of a poorly insulated refrigeration case. Additionally, the floor temperature under the case is often depressed from the store conditions because of the same lack of circulation. This contributes to a "triple hit" of having cold, condensing surfaces of the refrigeration system, with a cold floor, and little to no circulation to drive out the moisture.

DETAILED DESCRIPTION

Figure 1:
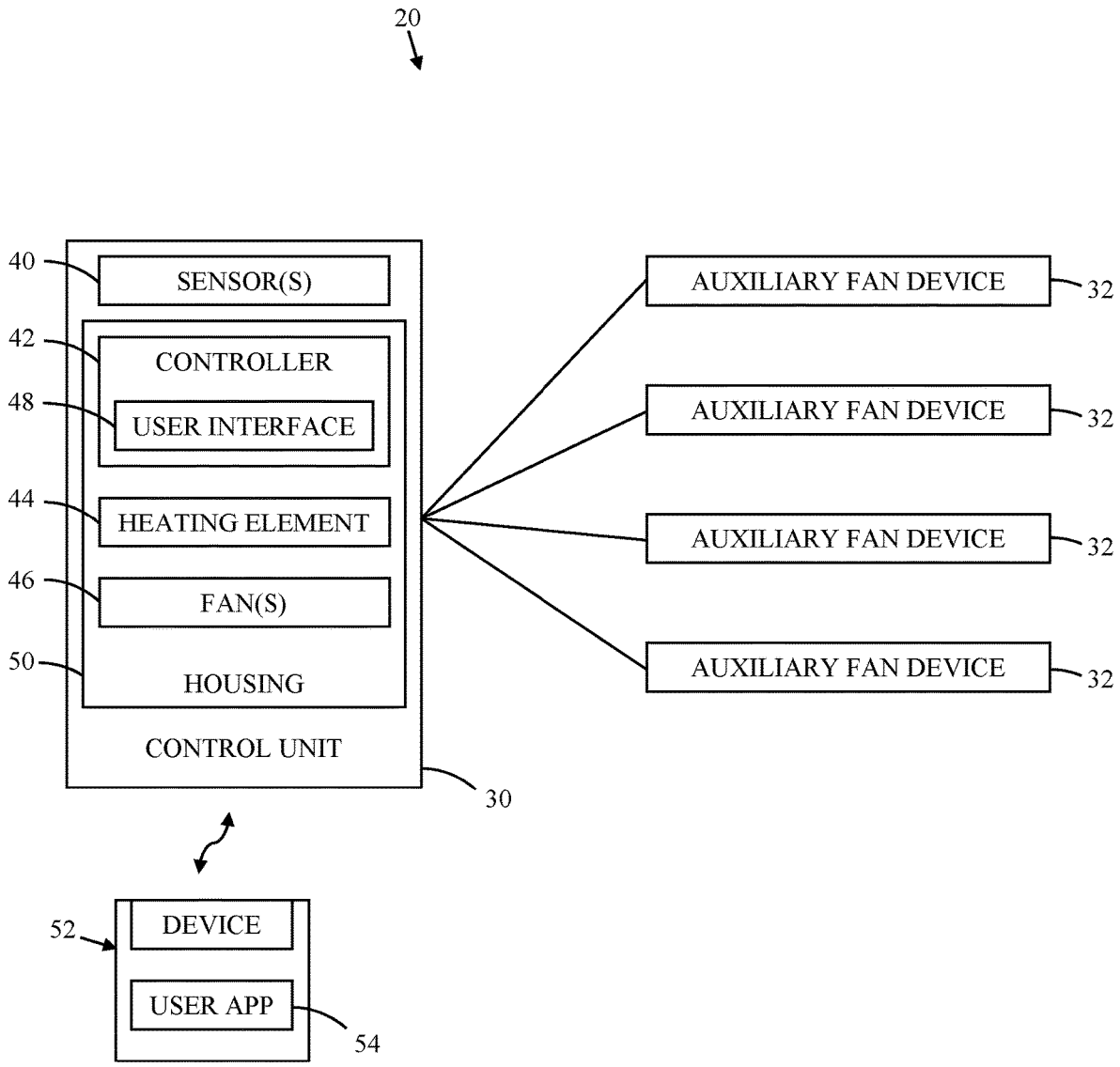
FIG. 1 is a block diagram of a condensation management system in accordance with principles of the present disclosure.

Some aspects of the present disclosure relate to systems and methods for managing or removing condensation formed at an underside of a refrigerated display case. One embodiment of a condensation management system 20 in accordance with principles of the present disclosure, and with which methods of the present disclosure can be practiced, is shown in FIG. 1. The system 20 includes a moisture control unit 30 and one or more auxiliary fan devices, such as auxiliary fan devices 32. In some examples, the moisture control unit 30 can be referred to as a low velocity thermal energy unit (or LVTEU) and includes a one or more sensors 40, a controller 42, a heating element 44, and one or more fans 46. Details on the various components are described in greater detail below. In general terms, however, the system 20 is configured for placement beneath an existing refrigerated display case (e.g., at the grocery store or other retail location at which the refrigerated display case is operating). The sensor(s) 40 are adapted to sense an ambient environment parameter related or relevant to relative humidity and/or dew point. The controller 42 is configured or programmed to monitor sensed data from the sensor(s) 40 that are otherwise position in the environment of interest (e.g., an "operating area" beneath the refrigerated display case) and, based upon the sensed information, operate the heating element 44 and the fan(s) 46 to raise the temperature in the operating area above the dew point. In effect, the moisture control unit 30 converts electrical energy to mechanical (blower) work and thermal (heater) work, which combine to raise the temperature of the ambient air beneath the refrigerated display case above the dew point, thereby preventing water vapor in the ambient air from condensing into liquid water. The auxiliary fan devices 32 are strategically positioned beneath the refrigerated display case, and operate in a controlled manner (e.g., via the controller 42) to direct heated airflow from the control unit 30 to various regions.

The sensor(s) 40 can assume various forms appropriate for sensing environmental parameters related or relevant to relative humidity and/or dew point. In some examples, the sensors 40 include a relative humidity sensor as is known in the art. In other examples, the sensors 40 can optionally further include a temperature sensor as is known in the art. In other examples, the sensor(s) 40 can be or can include a dew point sensor or condensation monitor sensor as is known in the art.

The controller 42 can assume various forms, and in some embodiments is or includes a programmable logic controller (PLC) or similar computing device. Programming to effect the control processes of the present disclosure can be provided as programming software to a PLC-type or similar controller. In other embodiments, the controller 42 can have access to, or includes, a processor and associated memory; the processor accesses instructions and/or information stored in the memory to effect the control processes of the present disclosure (e.g., the processor executes machine readable instructions contained in the memory or includes circuitry to perform computations). With these and related embodiments, the machine readable instructions may be loaded in a random access memory (RAM) for execution by the processor from the stored location in a read only memory (ROM), a mass storage device, or some other persistent storage (e.g., non-transitory tangible medium or non-volatile tangible medium).

As described in greater detail below, in some embodiments, programming provided with or operated by the controller 42 is configured to prompt operation of one or both of the heating element 44 and the fan(s) 46 under circumstances where conditions in the operating area, as sensed by the sensor(s) 40, are determined to implicate a need to increase a temperature of the operating area in order to minimize or prevent water vapor condensation. For example, where the sensor(s) 40 provide information indicative of relative humidity (or information from which the controller 42 can determine relative humidity), the controller 42 can be programmed to prompt operation of the heating element 44 and the fan(s) 46 when the sensed or determined relative humidity reaches or exceeds a designated set point (e.g., 90 percent relative humidity; 95 percent relative humidity, etc.). Alternatively or additionally, where the sensor(s) 40 provide information indicative of temperature and dew point (or information from which the controller 42 can determine temperature and/or dew point), the controller 42 can be programmed to prompt operation of the heating element 44 and the fan(s) 46 when the difference between temperature and dew point is less than a designated set point value (e.g., temperature is less than 10 degrees greater than dew point; temperature is less than 5 degrees greater than dew point; dew point equals or exceeds temperature; etc.). In yet other embodiments, in addition to relative humidity and/or dew point-based operation, where the sensor(s) 40 provide information indicative of temperature, the controller 42 can be programmed to operate one or both of the heating element 44 and/or the fan(s) 46, or to stop operation of one or both of the heating element 44 and/or the fan(s) 46 when the sensed temperature reaches or exceeds a designated temperature set point. The controller 42 can optionally incorporate other components and/or control techniques for preventing heat build-up (e.g., a safety relay) as described below. In more general terms, the temperature side of the controller provides two functions, one primary and one secondary. The primary is to act as a high-limit for the entire condensation management system 20. In some embodiments, the temperature cut-out is pre-set at the controller 42 at 100 degrees F.; it has surprisingly been found that this set point is a best fit for the entire "normal" range of temperatures that the system 20 will reasonably encounter during its operational life. Above 100 degrees F., the temperature control cut-out set-point is achieved, opening the fan control circuit and de-energizing an optional heater lock-out relay (described in greater detail below). This action stops all functions of the system 20. The secondary is data provided to the technician through the lifecycle of the system 20. Initially the data will help the technician know conditions at installation. As the system 20 operates, changes to the temperature data will help the technician measure or evaluate improvement. Finally, once the area is dry, the temperature data can be useful to calculate the relative humidity settings to induce cycling.

In some embodiments, the controller 42 can be programmed with one or more of the designated parameters identified above (e.g., relative humidity set point, temperature/dew point difference set point, temperature set point, etc.). In other embodiments, the controller 42 can be programmed to permit user selection of the relevant operational set point. With this in mind, in some embodiments the control unit 30 can further include a user interface 48 electronically connected to the controller 42 and formatted to facilitate user selection of an operational set point. For example, in some non-limiting embodiments, the user interface 48 can include a display and one or more input devices (e.g., buttons, dial, touch screen, etc.). With these and related embodiments, a user can operate the input device(s) to select a desired operational set point as shown on the display. Other user interface constructions are equally acceptable. For example, in some optional embodiments, a computing device 52 can be operated by a user to wirelessly interface (e.g., Bluetooth® wireless communication or other wireless communication protocol) with the controller 42. The computing device 52 can assume various forms, and in some embodiments is a mobile computing device, such as a mobile phone (e.g., smart phone), tablet, laptop computer, smartwatch, etc. which has a user interface to provide for operation of, and display of, the app 54. The computing device 52 generally includes a processor, a memory and a display, and is programmed to operate an app ("user app") 54 stored in the memory. The processor of the computing device 52, when executing programming code of the app 54, is configured to communicate various control signals to, and/or receive information from, the controller 42. For example, in some embodiments, a user (e.g., technician) can operate the computing device 52, via the app 54, to performing various programming functions at the controller 42, for example selecting a desired operational set point or other operational configurations.

The controller 42 can optionally be configured or programmed to perform one or more additional operations. For example, and as described in greater detail below, the controller 42 can be configured or programmed to receive and/or display dynamic information via the user interface 48. Alternatively or in addition, the controller 42 can optionally be configured or programmed to log various data points (e.g., time, temperature, humidity, fan status, heater status, etc.) based on a time frame and sampling frequency. With these and related embodiments, saved data can be accessed by a user (e.g., via the user interface 48) as desired. In addition or alternatively, any stored data (e.g., configuration data, logged data, etc.) can be uploaded/downloaded wirelessly, for example by the computing device 52 via the app 54.

The heating element 44 can assume various forms appropriate for converting electrical energy into heat for air heating by convection, and in some embodiments can be a finned strip heater as is known in the art. In some non-limiting examples, the heating element 44 can be, or can include, a 120 volt, 500 Watt finned strip heater. Other heating element configurations are also acceptable.

The fan(s) 46 can assume various forms appropriate for directing airflow across the heating element 44. In some non-limiting examples, two of the fans 46 are provided, although any other number, either greater or lesser, is also acceptable. The fan(s) 46 can be selected to operate off of the same power format as the heating element 44 (e.g., the fan(s)

46 can be 120 volt fans, for example axial 120 volt brushless cooling fans). Other fan configurations are also acceptable.

Figure 2:
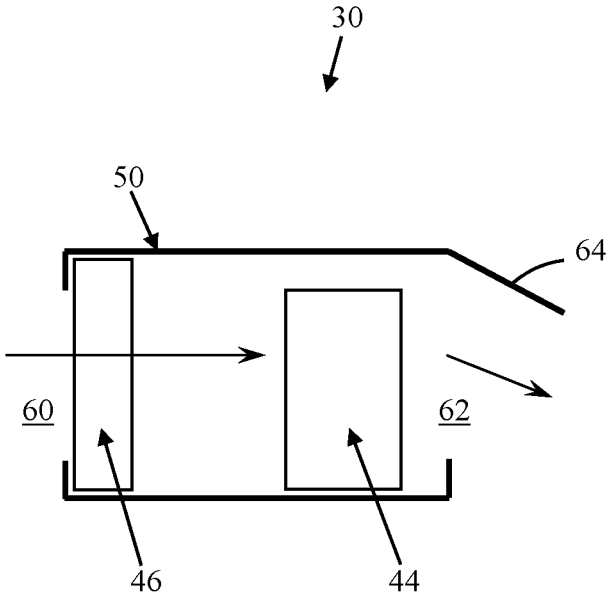
FIG. 2 is a simplified side cross-sectional view of portions of a control unit useful with the system of FIG. 1.

In some embodiments, the control unit 30 includes a housing 50 within which at least the heating element 44 and the fan(s) 46 are maintained. The housing 50 can assume various forms and can be configured to arrange the fan(s) 46 relative to the heating element 44 such that airflow from the fan(s) 46 passes over the heating element 44. For example, and with reference to FIG. 2, in some embodiments the housing 50 can define an inlet opening 60 opposite an outlet opening 62. The fan(s) 46 and the heating element 44 are arranged such that an inlet side of the fan(s) 46 is open to the inlet opening 60, and airflow from the fan(s) 46 is directed across the heating element 44 to the outlet opening 62 where the now-heated airflow exits the housing 50. In some embodiments, the housing 50 can further include a deflector body 64 at the outlet opening 62 and arranged to direct the exiting airflow in a desired direction. For example, and as indicated by arrows in FIG. 2, the deflector body 64 can direct airflow downwardly (relative to the orientation of FIG. 2), for example onto the floor of the operating area at which the control unit 30 is located. The deflector body 64 can assume a wide variety of shapes and forms, and in other embodiments, can be omitted.

Figure 3A:
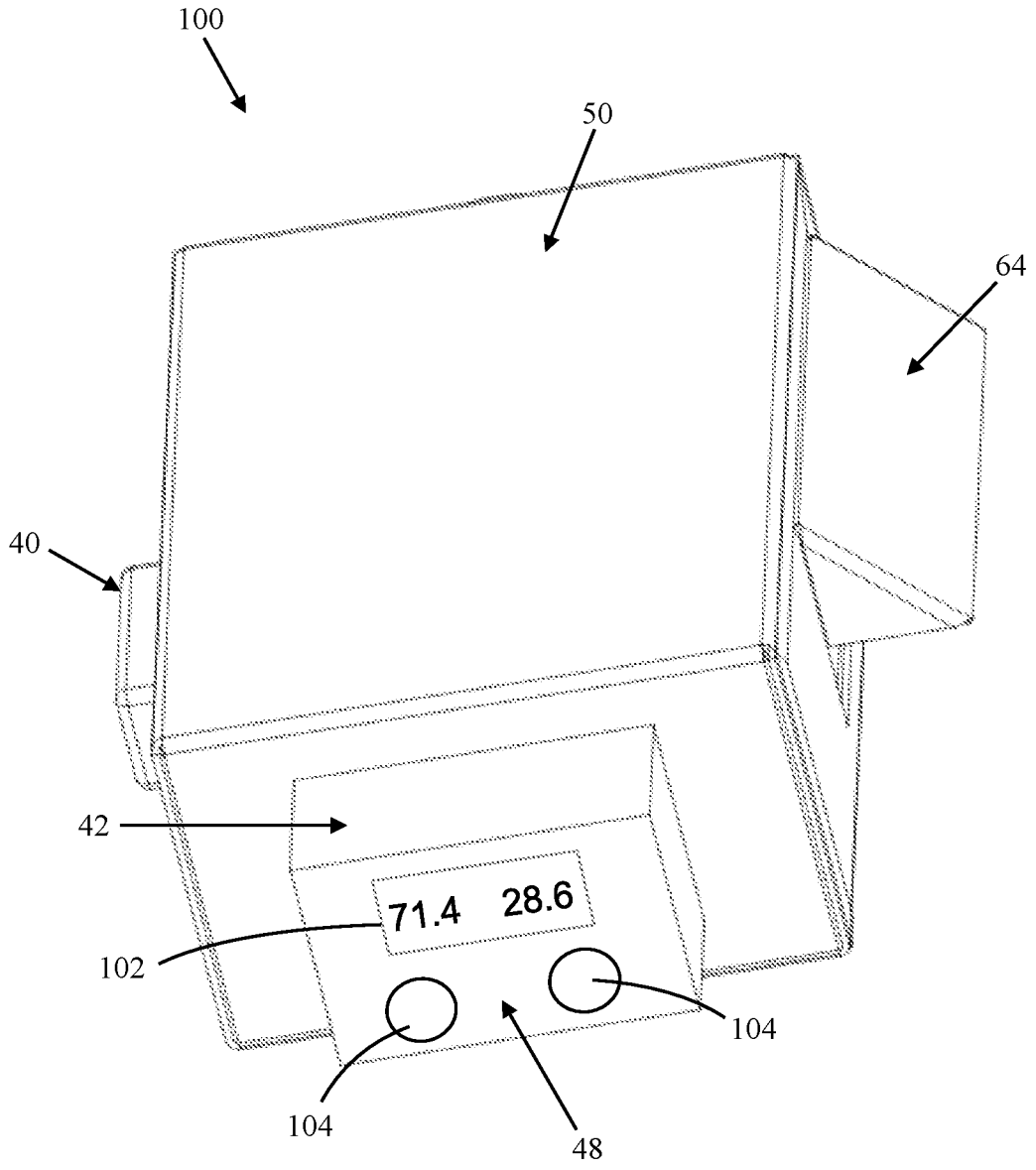
FIGS. 3A and 3B are perspective views of a control unit useful with the system of FIG. 1.
Figure 3B:
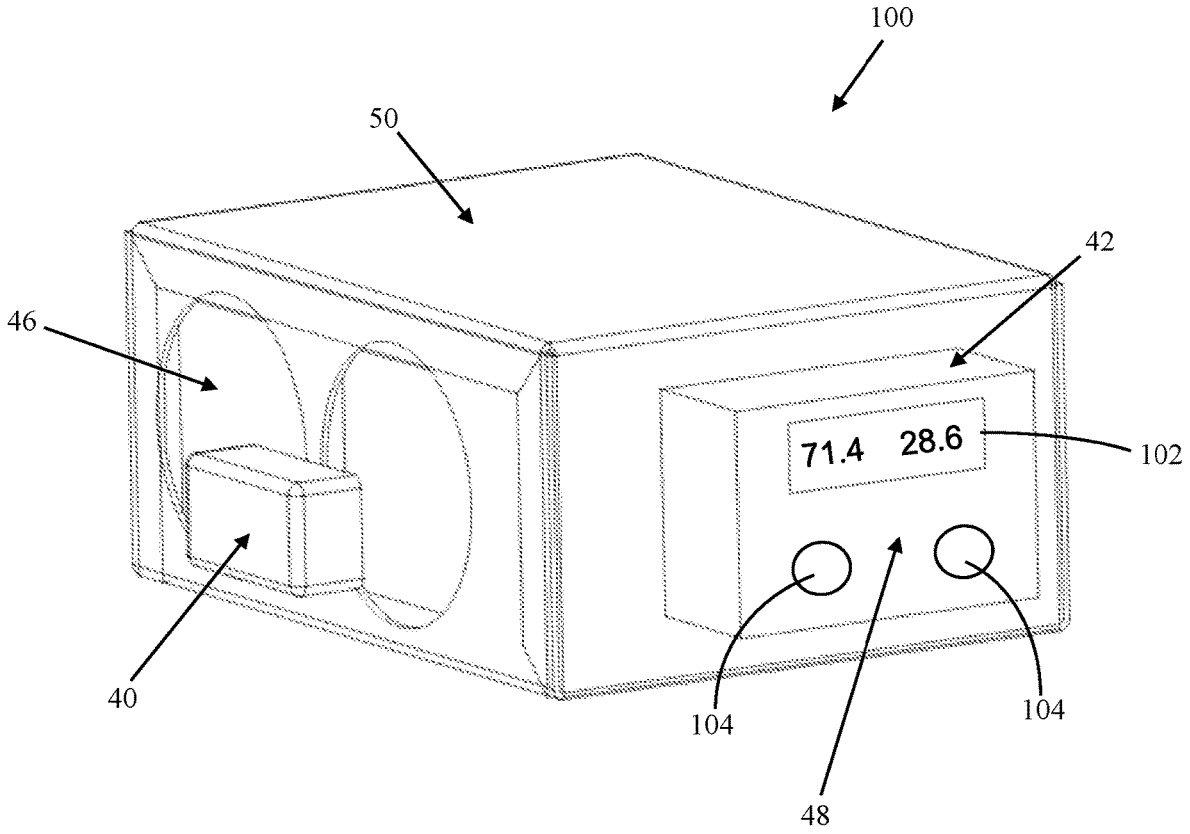

With additional reference to FIG. 1, in some embodiments, the controller 42 can be assembled to or carried by the housing 50, with the optional user interface 48 being accessible from an exterior of the housing 50. In some embodiments, a wired connection between the sensor(s) 40 and the controller 42 is provided; alternatively, the sensor(s) 40 wirelessly communicate with the controller 42. Regardless, in some constructions, the sensor(s) 40 can be assembled to or carried by the housing 50, positioned to sense the designated environmental parameter(s) of interest at a location in close proximity to, but external of, the housing 50 and away from the outlet opening 62. For example, one non-limiting example of a control unit 100 in accordance with principles of the present disclosure is shown in FIGS. 3A and 3B. The controller 42 is carried by the housing 50 with the user interface 48 (referenced generally) available to a user. The user interface 48 can have various configurations, including a display 102, actuators/buttons 104, etc. The display 102 can be operated by the controller 42 (and/or by the app 54 (FIG. 1)) to display various information, such as a set point, current sensor reading(s), stored data, etc. An inlet side of the fans 46 is open to an exterior of the housing, and operate to direct airflow across the heating element 44 (hidden in FIGS. 3A and 3B) to an outlet opening at which the optional deflector body 64 is provided. With the non-limiting example of FIGS. 3A and 3B, the sensors 40 are mounted to the housing 50 at or near the inlet side of the fans 46. The control units of the present disclosure can include additional components that facilitate powering of various components, for example a grounded (3 prong) electronical power cord (not shown), battery, etc. As described in greater detail below, where power to the auxiliary fan device(s) 32 (FIG. 1) is provided through the control unit and the auxiliary fan device(s) 32 utilize a power format differing from that of the heating element 44, the fan(s) 46, etc., the control units of the present disclosure can further include power conversion circuitry elements configured to convert power for delivery to the auxiliary fan device(s) 32. Other power formats are also acceptable, and in some embodiments, control units of the present disclosure can include a battery power supply.

Regardless of an exact construction, the control units of the present disclosure (e.g., the control unit 30, 100) have a compact size and shape or footprint selected to fit or reside underneath a refrigerated display case. For example, the housing 50 can have a height of not more than 8 inches, optionally not more than 6 inches; optionally not more than 4 inches.

Figure 4A:
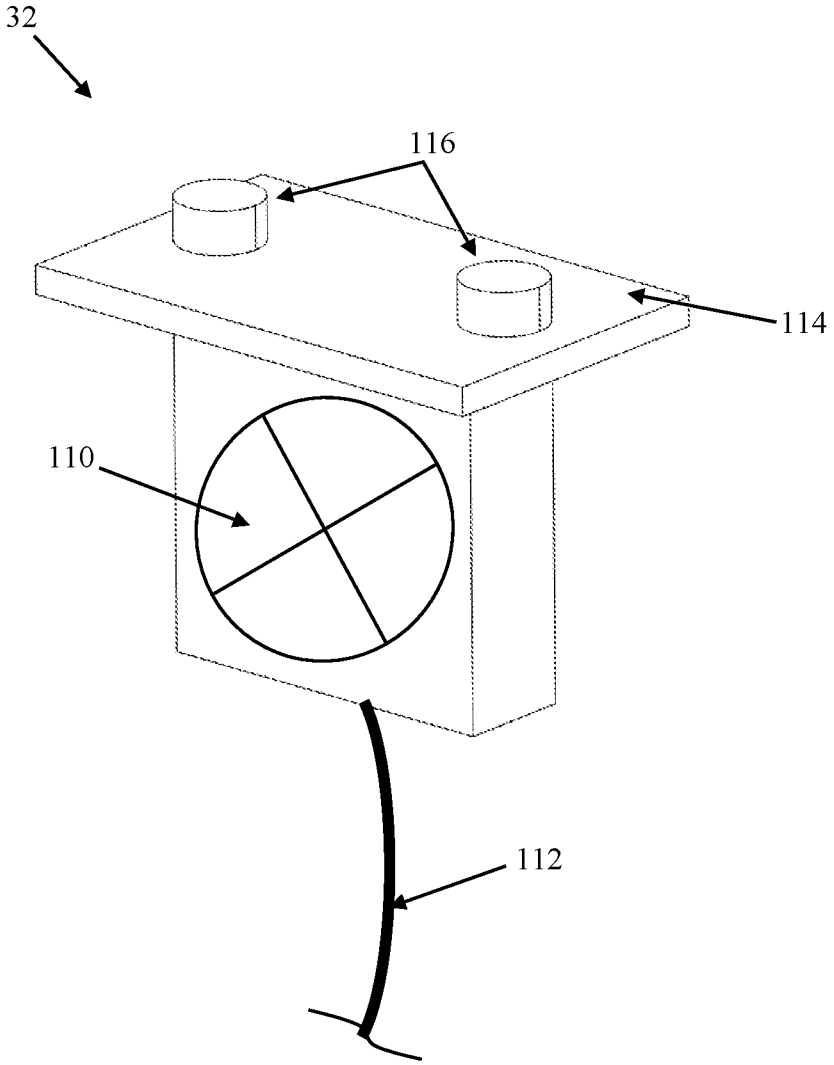
FIGS. 4A and 4B are a perspective views of auxiliary fan devices useful with the system of FIG. 1.
Figure 4B:
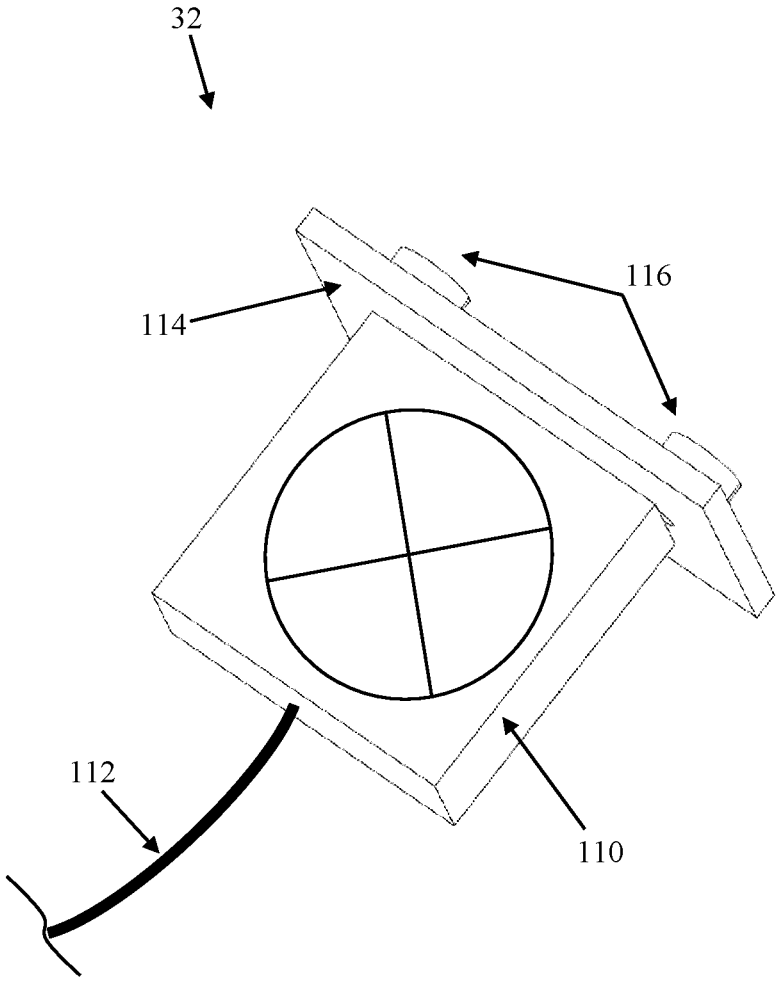

Returning to FIG. 1, the auxiliary fan device(s) 32 can assume various forms appropriate for generating airflow underneath a refrigerated display case. One non-limiting example of the auxiliary fan device 32 is shown in FIGS. 4A and 4B. Each of the auxiliary fan devices 32 includes a fan 110, wiring 112, a support plate 114, and a connector 116 (referenced generally). The fan 110 can be of a type known in the art, and in some embodiments is a 5 volt dc blower fan. Other fan configurations are also acceptable. The wiring 112 extends from the fan 110 and is configured for electrical connection to a corresponding component of the control unit 30 (e.g., direct or indirect connection to the controller 42 that in turn operates to selectively supply power to the fan 110 via the wiring 112, for example via a USB-type connector). A length of the wire 112 can vary, but is generally selected to provide a user with the ability to locate each individual fan 110 at a desired location relative to the control unit 30. In some examples, two of the fans devices 32 can be connected in series by a length of wiring, with a single connection provided to the control unit 30. In other embodiments, the auxiliary fan devices 32 can be self-powered and/or can wirelessly communicate with the controller 42. The support plate 114 and the connector 116 combine to facilitate selective arrangement or mounting of the fan 110 at the operational area, and particular to an underside of the refrigerated display case. In some embodiments, the connector 116 includes one or more magnets (e.g., in the non-limiting example of FIGS. 4A and 4B, two magnets are provided, although any other number is equally acceptable). With these and related configurations, the support plate 114 retains the magnet(s) 116 relative to the fan 110, with the magnet(s) 116 providing easy connection/magnetic connection to a metal surface on the underside of the refrigerated display case. Other connection or mounting techniques are also acceptable that may or may not employ a magnet as the connector 116. Regardless, in some embodiments four of the auxiliary fan devices 32 are provided with the system 20, although any other number, either greater or lesser, is also acceptable. In some embodiments, the auxiliary fan devices 32 can be referred to as strategically positioned direction and recirculation (S.P.D.R.) fans that operate to ensure air reaches where needed.

Figure 5:
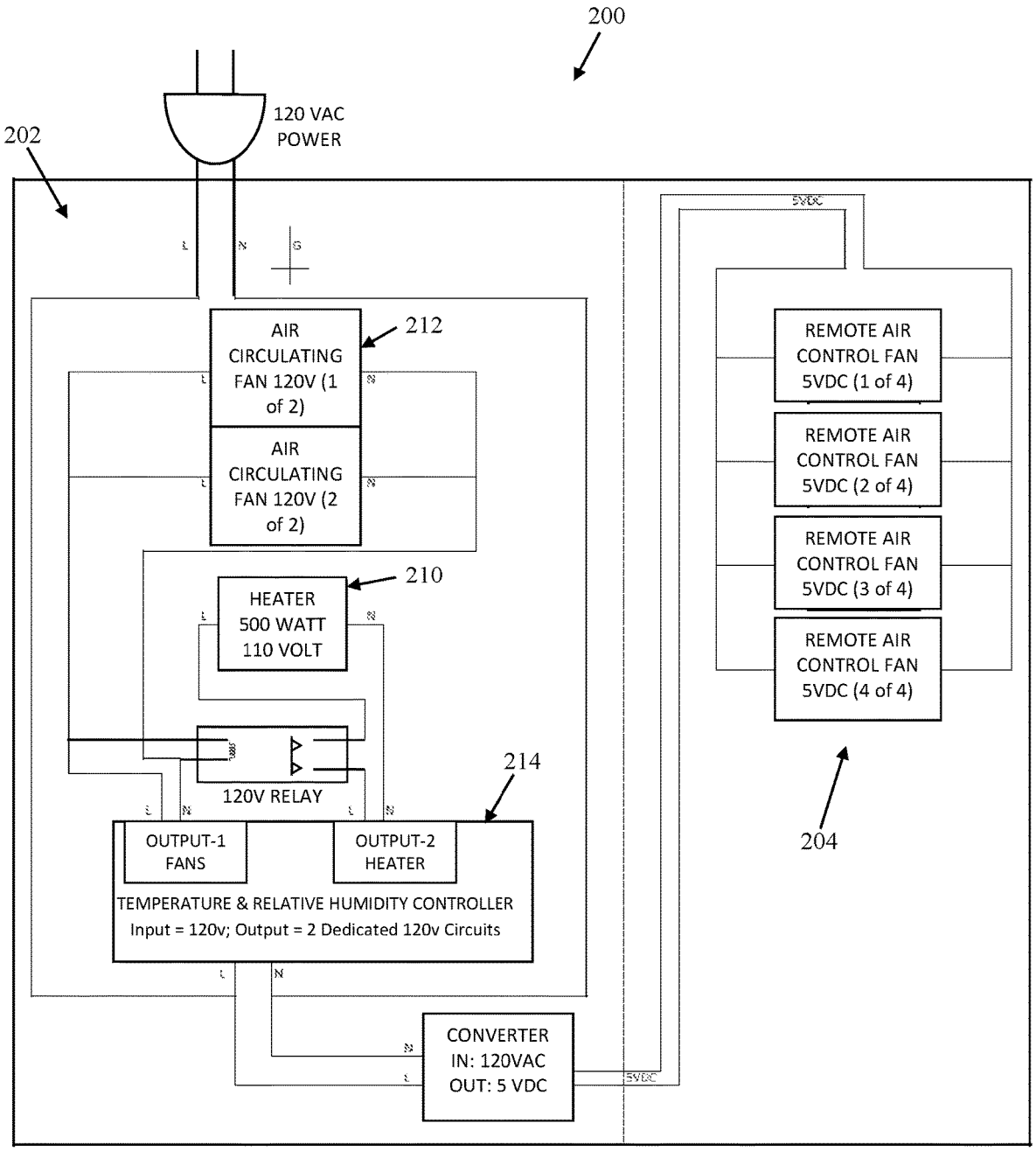
FIG. 5 is an electrical diagram for a condensation management system in accordance with principles of the present disclosure.

The condensation management systems of the present disclosure, including the control unit and auxiliary fan devices, can be assembled in various fashions, and can include one or more components differing from the descriptions above. An example wiring diagram for a condensation management system 200 of the present disclosure is provided in FIG. 5, and includes a control unit 202 and four auxiliary fan devices 204. The control unit 202 includes a heater or heating element 210 and two fans 212. With the non-limiting example of FIG. 5, the control unit 202 further includes a safety relay switch 214 that functions to prevent the heater 210 from operating (i.e., the heater 210 is maintained in a power "OFF" state) if the fans 212 are in an "OFF" state, thereby preventing heat building in the control unit 202 in the absence of air circulation. Other, similar safety techniques or components are also acceptable.

Figure 6:
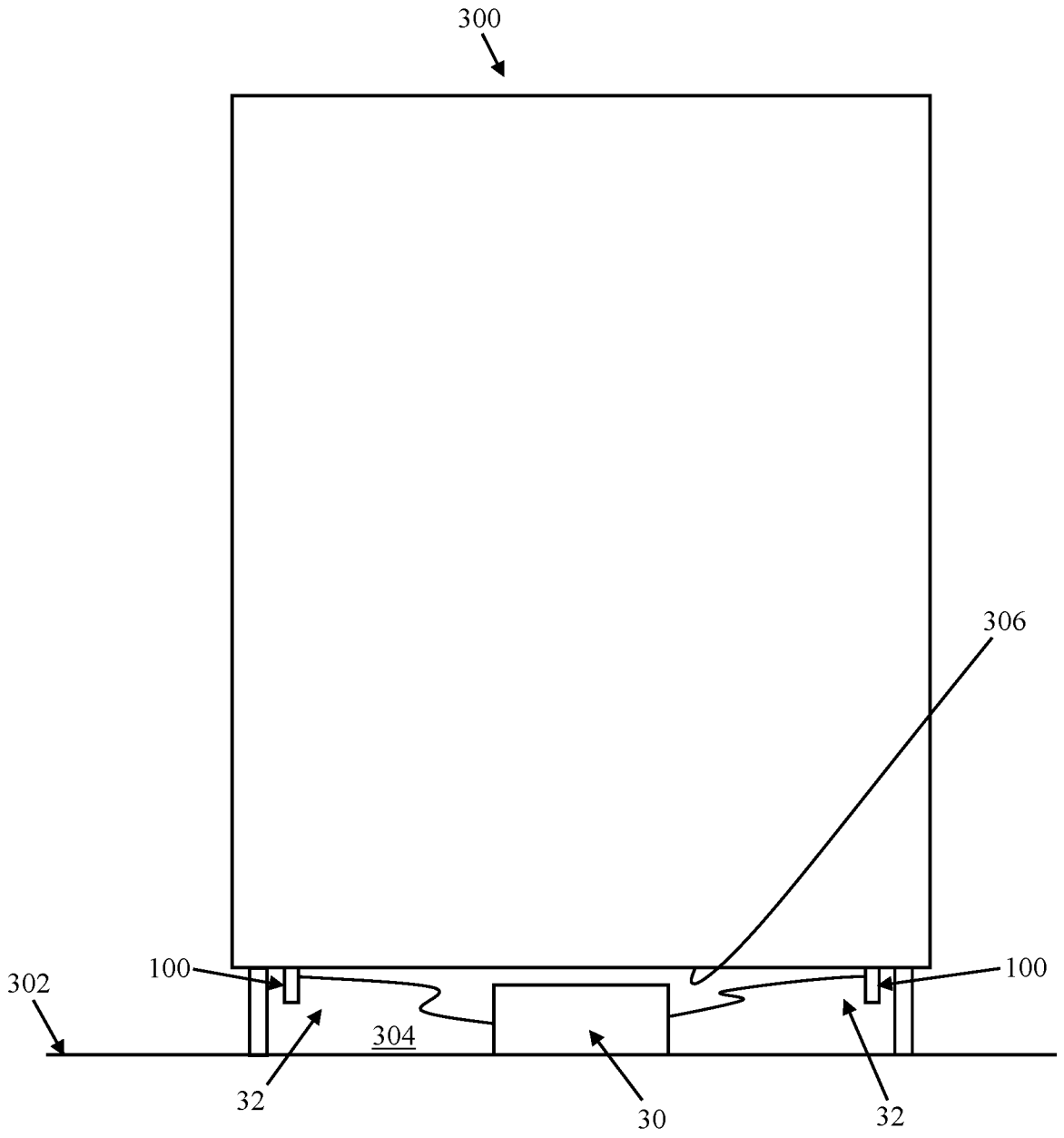
FIG. 6 is a simplified side view of a condensation management system installed to a refrigerated display case in accordance with principles of the present disclosure.

Regardless of an exact construction, the condensation management systems of the present disclosure can be utilized with a wide variety of refrigerated display case formats and under a plethora of different circumstances. With this in mind, FIG. 6 illustrates a refrigerated display case 300 located on a floor 302 of user (e.g., grocery store, convenience store, restaurant, etc.). The condensation management system 20 of the present disclosure has been installed relative to the refrigerated display case 300 at an operational area 304 to control moisture or condensation at or between an underside 306 of the refrigerated display case 300 and the floor 302. Prior to installation, it can be useful to ensure that the operational area 304 is free of debris, excessive dirt buildup, price tags, etc. An appropriate wall unit power source receptacle near the operational area (e.g., 120 v power source) is located and confirmed to be properly grounded. The control unit 30 is located as close as possible to the center of the moisture/condensation issue being addressed. The fan 100 of each of the auxiliary fan devices 32 (two of which are shown) is attached to the underside 306 skin of the refrigerated display case 300 (or other steel structure). In some examples, the fans 100 should be 12 to 24 inches away from the control unit 30, and not directly in the path of discharge air from the control unit 30. The fans 100 are desirably oriented to blow air away from the control unit 30, unless specific circumstances dictate otherwise. The control unit 30 is then powered on, and operates to deliver heated airflow to the operational area 304 and to power the fans 100 in response to sensed environmental parameter(s) as described above. In some examples, the control unit 30 is programmed with pre-set humidity and temperature set points for optimized performance under most circumstances; alternatively or in addition, the control unit 30 can provide a user with the ability to fine tune the set point(s) as desired. For example, temperature control can act as a high-limit, shutting the fans off above a set point (e.g., 100 degrees F.). Relative humidity can be set for cut-in at 50% and cut-out at 25%, although field adjustments may be required.

The condensation management systems of the present disclosure provide a marked improvement over previous designs. The control unit (or low velocity thermal energy unit) with auxiliary fan devices (or strategically positioned direction and recirculation fans) utilize science to address the root cause of exterior surface condensation on or at refrigerated display cases, and are easy to install. The condensation management systems convert electrical energy to mechanical (blower) work and thermal (heater) work, which combines to raise the temperature in the environment above dew point. Airflow design ensures that the floor around the control unit warms, ensuring maximum latent heat benefits. The physical dimensions of the condensation management systems meet the low profile needs of refrigerated display cases currently in the market. Grounded (3-prong) electrical power and heater overload for safety are optionally provided. The auxiliary fan devices ensure air reaches where needed.

Although the present disclosure has been described with reference to preferred embodiments, workers skilled in the art will recognize that changes can be made in form and detail without departing from the spirit and scope of the present disclosure.

What is claimed is:

1. A condensation management system comprising:

a control unit including:

a housing, a heating element maintained by the housing;

a control unit fan maintained by the housing;

at least one sensor; and a controller connected to the sensor and configured to prompt operation of the heating element and the control unit fan in response to sensed information; and a plurality of auxiliary fan devices each including an auxiliary fan electronically connected to the controller, wherein the control unit and the plurality of auxiliary fan devices are each configured to be selectively positionable within an operational area beneath a refrigerated display case for managing condensation formed in the operational area.

2. The system of claim 1, wherein the at least one sensor includes a relative humidity sensor.

3. The system of claim 1, wherein the at least one sensor includes a temperature sensor.

4. The system of claim 1, wherein each of the auxiliary fan devices further includes a connector for connection to an underside of the refrigerated display case.

5. The system of claim 4, wherein the connector includes a magnet.

6. The system of claim 1, wherein at least one of the auxiliary fan devices is wirelessly connected to the controller.

7. The system of claim 1, wherein the controller includes a memory, and further wherein the controller is configured to record data from the at least one sensor in the memory for retrieval.

8. The system of claim 1, wherein the controller is programmable by at least one of:

a user interface carried by the housing; and a computing device operating an app and wirelessly communicating with the controller.

9. The system of claim 1, wherein the controller is programmed to prompt operation of the auxiliary fan devices.

10. The system of claim 1, wherein the controller is programmed to operate each of the heating element, the control unit fan, and the auxiliary fan devices in a powered on state when information signaled by the at least one sensor exceeds a set point.

11. The system of claim 10, wherein the controller is programmed to operate each of the heating element, the control unit fan, and the auxiliary fan devices in a powered on state when information signaled by the at least one sensor indicates an environmental relative humidity of at least 90 percent relative humidity.

12. The system of claim 10, wherein the controller is programmed to operate each of the heating element, the control unit fan, and the auxiliary fan devices in a powered on state when information signaled by the at least one sensor indicates an environmental dew point and temperature relationship in which the environmental temperature is less than 10 degrees greater than the environmental dew point.

13. The system of claim 10, wherein the controller is programmed to operate the heating element in a powered off state when the control unit fan is in a powered off state.

14. The system of claim 1, wherein the housing defines an inlet opening and an outlet opening, and further wherein the fan is arranged relative to the housing such that during operation of the control unit fan, airflow is directed from the inlet opening to the outlet opening, and even further wherein the control unit comprises a deflector body extending from the housing proximate the outlet opening.

* * * * *